United States Patent [19]

Yasufuku et al.

[11] 3,980,803

[45] Sept. 14, 1976

[54] LINEAR PHENYLMETHYLSILICONE OIL AS DIELECTRIC FOR STATIONARY ELECTRIC DEVICE

[75] Inventors: Sachio Yasufuku, Fujisawa; Yasuaki Ishioka, Yokohama; Takeshi Tanii, Yokosuka; Sigeo Nakayama, Yokohama, all of Japan

[73] Assignee: Tokyo Shibaura Electric Co., Ltd., Kawasaki, Japan

[22] Filed: Sept. 30, 1974

[21] Appl. No.: 510,568

[30] Foreign Application Priority Data

Oct. 1, 1973 Japan ..... 48-109287

[52] U.S. Cl. ..... 174/17 LF; 252/63.7; 317/258; 336/94

[51] Int. Cl.[2] ..... H01K 5/00; H01B 3/18

[58] Field of Search ..... 252/63.7, 63; 174/110 S, 17 LF; 260/448.2 R

[56] References Cited

UNITED STATES PATENTS

| | | | |
|---|---|---|---|
| 2,432,665 | 12/1947 | Hyde | 252/63.7 |
| 3,175,995 | 3/1965 | Elliott et al. | 252/63.7 |

OTHER PUBLICATIONS

Clark, Insulating Materials for Design and Engineering Practice, Wiley & Son, (1962), p. 240.

*Primary Examiner*—John D. Welsh
*Attorney, Agent, or Firm*—Cushman, Darby & Cushman

[57] ABSTRACT

A stationary electric device such as, for example, a capacitor and a transformer, using linear phenylmethylsilicone oil as an impregnating oil is provided. The use of linear phenylmethylsilicone oil improves an anti-corona property as well as permits the miniaturization of the device.

8 Claims, 7 Drawing Figures

LINEAR PHENYLMETHYLSILICONE OIL AS DIELECTRIC FOR STATIONARY ELECTRIC DEVICE

BACKGROUND OF THE INVENTION

This invention relates to a stationary electric device using a linear phenylmethylsilicone oil as an impregnating oil such as an insulating oil, a dielectric solution etc.

As a dielectric solution for capacitors or an insulating oil for transformers, there have long been used a PCB (polychlorinated biphenyl) series oil. This material, however, raised a serious environmental contamination problem and it has long been desired to develop a new insulating medium as a substitute for PCB. As one of such materials, a fire retardant silicone oil, particularly a dimethylsilicone oil, is considered. The dimethylsilicone oil is a linear polysiloxane synthesized, by a conventional method, using dimethyldichlorosilanes and trimethylmonochlorosilanes as raw material. The oil has a kinematic viscosity of 50 centistokes at 25°C and a pour point of −55°C. It is true that the dimethylsilicone oil has an excellent heat-resistance as well as a superb electrical property, but its side-chain methyl radicals are relatively easily decomposed under a large current arc discharge or a high electric field, producing the combustible gases such as a hydrogen gas, a methane gas etc. with the resultant disadvantage. The produced gas tends to be dissolved in the silicone oil. Some of the dissolved gas is separated from the silicone oil to create minute voids in the silicone oil and there is a danger that an electric device is dielectrically broken down due to a corona discharge under a high electric field. In a high-tension capacitor formed by combining dimethylsilicone oil used as an impregnating oil, with a capacitor element using as a dielectric, for example, a biaxially oriented polypropylene film or a combination of a polypropylene film with a capacitor paper, a corona starting voltage (CSV) and corona eliminating voltage (CEV) are low and a ratio of CEV to CSV is small. Consequently, a greater average voltage gradient can not be taken, even as compared with a capacitor using a mineral oil series, and the volume of the capacitor is unavoidably bulkier and no great merit is obtained from an economical viewpoint.

Furthermore, the corona level of a stationary electric device, such as a capacitor etc., using dimethylsilicone oil as an impregnating oil is relatively low. Therefore, when such a device is used for a long period of time, no high reliability is obtained.

SUMMARY OF THE INVENTION

It is accordingly the object of this invention to provide a stationary electric device which is excellent in anti-corona property and capable of being miniaturized.

The above-mentioned object can be attained by using as an impregnating oil (for example, an insulating oil or a dielectric solution) for a stationary electric device, a linear phenylmethylsilicone oil in which methyl radicals are partially replaced by phenyl radicals, i.e. by using such a linear phenylmethylsilicone oil that a ratio of phenyl radicals to a whole organic radicals is 0.5–9.0 mol %, preferably 1–3 mol % and a kinematic viscosity at 25°C is 30–120 centistokes.

This invention will be further described with reference to the accompanying drawings, in which.

DETAILED DESCRIPTION OF THE INVENTION

Figure 1:
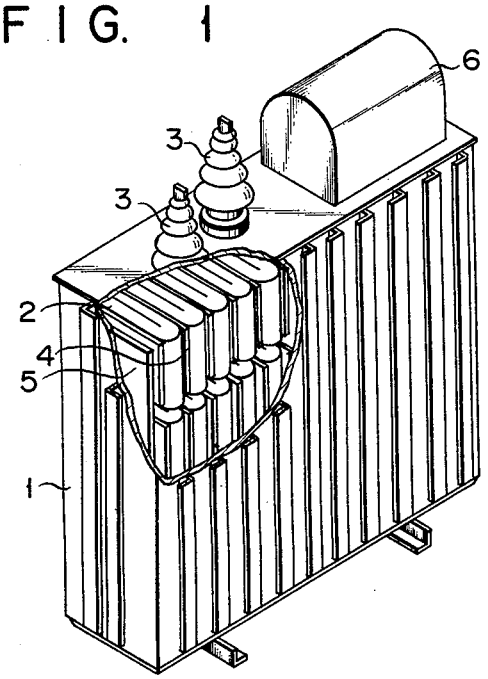
FIG. 1 is a perspective view, partly broken away, showing a capacitor according to an embodiment of this invention.

The embodiment of this invention will be explained below.

First of all, there will be shown four kinds of silicone oils i.e. A, B, C and D oils which are used as an impregnating oil for a stationary electric device. The A oil is a conventional impregnating oil while B, C and D oils are a linear phenylmethylsilicone oil used for the stationary electric device according to this invention.

1. Dimethyl silicone oil (A oil)

Dimethyl silicone oil is a linear polysiloxane manufactured by a conventional method using dimethyldichlorosilane and trimethylmonochlorosilane as raw material. It has a kinematic viscosity of 50 centistokes at 25°C and a pour point of −55°C.

2. Linear diphenylmethylsilicone oil (B oil)

A mixed chlorosilane was prepared by mixing 306g of dimethyldichlorosilane, 31.5g of diphenyldichlorosilane and 13g of trimethylmonochlorosilane. The mixture was added dropwise, while maintained at 50°C, into a vigorously agitated water to effect hydrolysis. After the dropwise addition was complete, the solution was continued to be agitated for additional 2 hours. Then, a resultant oil phase was separated. Since hydrogen chloride produced by hydrolysis was dissolved in the oil phase, hydrogen chloride was removed by the following steps. Namely, the oil phase was washed by a solution of salt and, after neutralized with sodium bicarbonate solution, again washed by a solution of salt until the solution indicated no acidity. Then, the oil phase was dehydrated with anhydrous sodium sulfate and refined by filtration. The refined oil phase was a low molecular phenylmethylpolysiloxane mixture including cyclic polysiloxane and a hydroxyl radical bearing polysiloxane. The mixture was polymerized using a 90% sulfuric acid as a catalyst and neutralized with sodium bicarbonate to remove the catalyst. Thus, a crude phenylmethylsilicone oil was obtained. The crude product was vacuum distilled at 250°C and 3 mm Hg to remove the low molecular polysiloxane and a linear diphenylmethylsilicone oil was obtained. The silicone oil contained 4.3 mol % of phenyl radical based on the whole weight of organic radical. The silicone oil had a kinematic viscosity of 100 centistokes at 25°C and a pour point of −70°C. The content of the phenyl radical was determined by an infrared spectroscopy.

Various linear diphenylmethylsilicone oils containing phenyl radicals were obtained, by the above-mentioned method, using as raw material the chlorosilanes mixed at varying ratio. Some of the linear diphenylmethylsilicone oils are shown in Table 1.

Table 1

| Samples | Phenyl radicals (mol %) | Kinematic viscosity at 25°C (centistokes) | Pour point (°C) |
|---|---|---|---|
| B oil -1 | 2 | 100 | −65 |
| -2 | 4.3 | 100 | −70 |
| -3 | 15 | 150 | −65 |
| -4 | 30 | 400 | −40 |

The concentration of phenyl radical was in the range of 2–31 mol %.

3. Linear monophenylmethylsilicone oil (C oil)

Various monophenylmethylsilicone oils were obtained, by the same method as in the case of B oil, using as raw material mixtures of dimethyldichlorosilane, methylphenyldichlorosilane and trimethylmonochlorosilane which were mixed at varying ratio. In this case, however, use of potassium hydroxide was made, as a polymerization catalyst and tricresyl phosphate was used for its neutralization. The silicone oil had phenyl radicals whose concentration was in the range of 5 to 70 mol %.

4. Oils obtained by mixing A oil with B or C oil (D oil)

Dimethylsilicone oil-linear phenylmethylsilicone series impregnating oils having a varying concentration of phenyl radicals were obtained by mixing dimethylsilicone oil (A oil) with linear phenylmethylsilicone oils (B oil, C oil) at a ratio not separated from each other. The impregnating oils had phenyl radicals whose concentration was in the range of 0.1 to 5 mol %. The content of phenyl radicals was determined by the following infrared spectroscopy. Various standard samples were prepared by dissolving in carbon disulfide mixtures of octamethylcyclotetrasiloxane $[(CH_3)_2SiO]_4$ and octaphenylcyclotetrasiloxane $[(C_6H_5)_2SiO]_4$ which were mixed at varying ratio. An infrared absorption spectrum was taken from the sample and a calibration curve was described by plotting as an abscissa a ratio of methyl radical mol % to phenyl radical mol % and as an ordinate a ratio of an absorbance at a frequency, 2970 $cm^{-1}$, of methyl radical due to their CH stretching vibration to an absorbance at a frequency, 3070 $cm^{-1}$, of benzene nucleus due to its CH stretching vibration. The infrared absorption spectrum of the synthesized phenylmethylsilicone oil was measured and a ratio of an absorbance at 2970 $cm^{-1}$ to an absorbance at 3070 $cm^{-1}$ was determined. A molar ratio of methyl radical to phenyl radical was obtained by using the calibration curve and the content of phenyl radicals was determined.

The linear phenylmethylsilicone oil used as an impregnating oil for a stationary electric device according to this invention has only to meet such requirements that the ratio of phenyl radical to the whole organic radical (methyl radical and phenyl radical) is in a range of 0.5 to 9.0 mol %, preferably, 1 to 3 mol % and that the kinematic viscosity is in the range of 30 to 120 centistokes at 25°C. Consequently, not only B and C oils, but also D oil, can be suitably used for the stationary electric device according to this invention. Such impregnating oils can be used in various stationary electric devices, particularly in capacitors, transformers, reactors, CT (current transformer) etc.

Let us now explain the case where the stationary electric device according to this invention is a capacitor.

Figure 2:
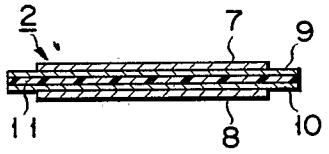
FIGS. 2 and 3 are cross sectional views of capacitor elements each having a different dielectric configuration.
Figure 3:
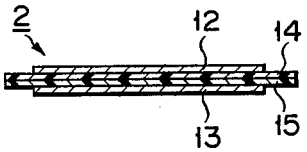

FIG. 1 is a perspective view, partly broken away, showing a capacitor according to one embodiment of this invention. 1 shows a capacitor tank within which a plurality of capacitor elements 2 are housed. The capacitor elements are connected in series, in parallel or in series-parallel combination to each other. Both the ends of the capacitor are taken out through bushings 3 from an upper covering of the tank 1. An insulating plate 4 is arranged between the capacitor elements 2. Between the inner surface of the capacitor tank 1 and the capacitor element is disposed a metal plate 5 for securing the capacitor elements in position. 6 is an oil adjuster mounted on the upper covering of the tank 1. The interior of the oil adjuster communicates with the interior of the tank 1. The oil adjuster adjusts that amount of oil sealed within the tank 1 which is varied dependent upon the temperature variation of the impregnating oil. The capacitor element may take the form as shown in FIGS. 2 and 3. In the dielectric configuration of FIG. 2 there are disposed, between aluminium electrodes 7 and 8 of 8$\mu$ in thickness, a pair of high tension capacitor papers 9 and 10 of 20$\mu$ in thickness with a biaxially oriented polypropylene film 11 of 18$\mu$ in thickness disposed therebetween. The dielectric of 58$\mu$ in thickness and the aluminium electrodes were wound as a unit. This method is referred to as a "full sandwich" method. In the dielectric configuration of FIG. 3 there are disposed, between a pair of electrodes 12 and 13, biaxially oriented polypropylene films 14 and 15 of 18$\mu$ in thickness. The dielectric of 36$\mu$ in thickness and the electrodes 12 and 13 are wound as a unit. This method is an all-film method.

The so arranged capacitor is vacuum dried and vacuum impregnated. As an impregnating oil use was made of dimethylsilicone oil and phenylmethylsilicone oil. The corona starting voltage (CSV) and corona eliminating voltage (CEV) of the capacitor were determined at intratank oil temperatures of 25°, 47° and 75°C and the performances of these impregnating oils were compared. These are shown by way of example in FIG. 5. From the above-mentioned experiments the following results were obtained. In the capacitor manufactured based on the all-film method and using dimethylsilicone oil (A oil) as the impregnating oil, a ratio of the corona eliminating voltage (CEV) to the corona starting voltage (CSV) was in a range of 0.8–0.85 i.e. the CEV/CSV was found to be relatively small; a poor gas absorption property was exhibited; and an average voltage gradient was only 20 KV/mm i.e. substantially the same as the case where use was made of an impregnating oil as mineral oil. As a result, it is impossible to make the capacitor compact. In the capacitor manufactured based on the all-film method and using dimethylsilicone oil as the impregnating oil, the same tendency as the above-mentioned capacitor was shown. According to one embodiment of this invention use was made, as an impregnating oil, of a linear methylphenylsilicone oil (B oil). In this capacitor, the corona starting voltage (CSV) and corona eliminating voltage (CEV) as expressed in terms of the average voltage gradient were noticeably improved and a ratio of CEV to CSV was found to be about 0.9 and a gas absorption property was improved. The same results were shown even when C and D oils were used as the impregnating oil.

As a means for evaluating the anti-corona property of a capacitor in which a silicone oil is used as the impregnating oil, there is often adopted a method for determining the hydrogen gas absorption of the silicone oil under a high electric field. In this method, a THORNTON type hydrogen gas absorption apparatus is used. This method is effected in the following procedure.

Sample oils, i.e. dimethylsilicone oil and phenylmethylsilicone oil were introduced into respective flasks and saturated with hydrogen gas. An inner electrode was inserted into a respective glass tube on which an outer electrode foil was attached. The sample oils were introduced into the respective glass tubes in a state equilibrating with hydrogen gas and the glass tubes were placed within constant temperature oil baths kept at temperatures of 50°C and 130°C, respectively. A 50 Hz sinusoidal wave of 8 KV was applied to the electrode and the absorption of hydrogen gas was determined by reading a manometer level one end of which extends into the upper space of the glass tube and the other end of which extends into the atmosphere.

Figure 4:
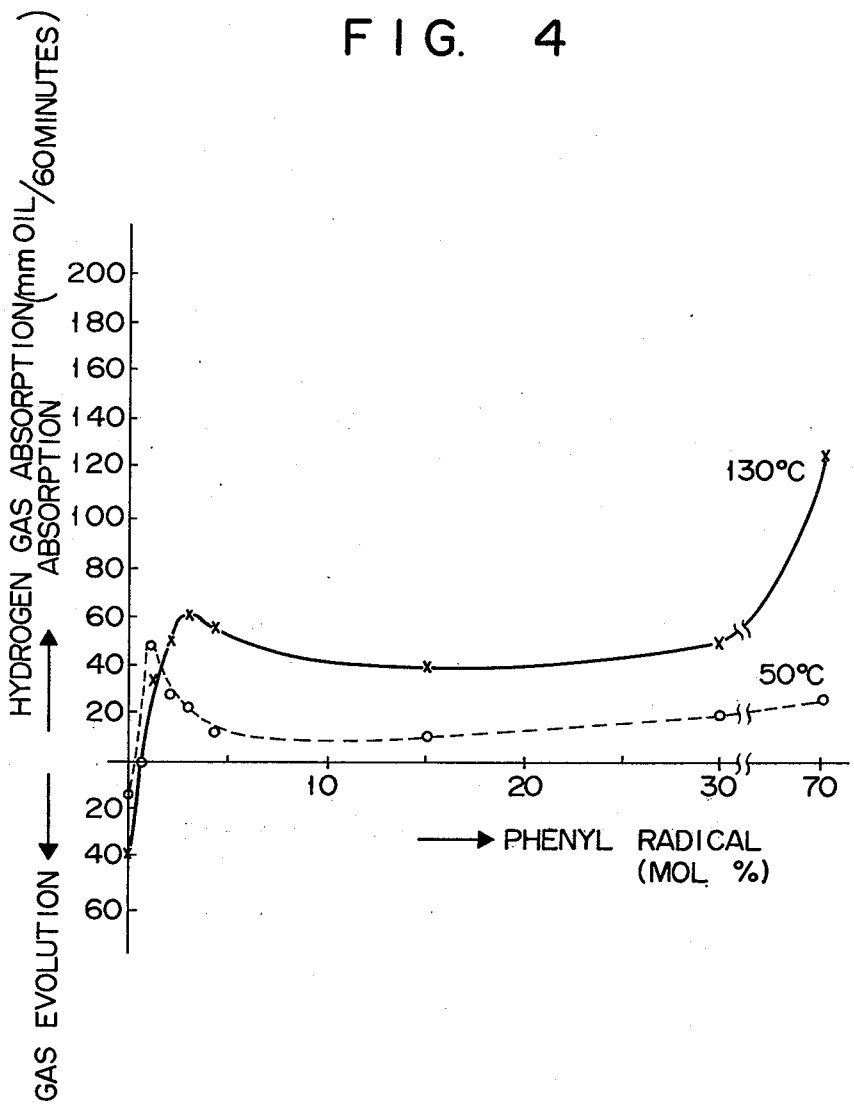
FIG. 4 is a graph showing the hydrogen gas absorption characteristic of a linear phenylmethylsilicone oil used for a stationary electric device of this invention.

FIG. 4 is a graph showing a relation between the hydrogen gas absorption and phenyl radical mol % of a linear phenylmethylsilicone oil.

From the above-mentioned tests the following results were obtained.

1. The dimethylsilicone oil (A oil) is a hydrogen gas evolution type.

2. When the concentration of phenyl radical of the phenylmethylsilicone oil is 0.5 mol %, the hydrogen gas absorption is zero. At this time, the phenylmethylsilicone oil which is neither a hydrogen gas evolution type nor a hydrogen gas absorption type has 0.5 mol % of the phenyl radical.

3. The peak of hydrogen gas absorption is observed when phenyl radical is in a range of 1–3 mol % and, as the concentration of phenyl radical is increased to more than 3 mol %, the hydrogen gas absorption is decreased.

4. In the phenylmethylsilicone oil, B and C oil series show substantially the same tendency. A mixed oil, i.e. D oil, prepared by mixing phenylmethylsilicone oil (B oil or C oil) with dimethylsilicone oil (A oil) in a compatible range shows the same hydrogen gas absorption as the equivalent mol % of the concentration of phenyl radical of phenylmethylsilicone oil.

Figure 5:
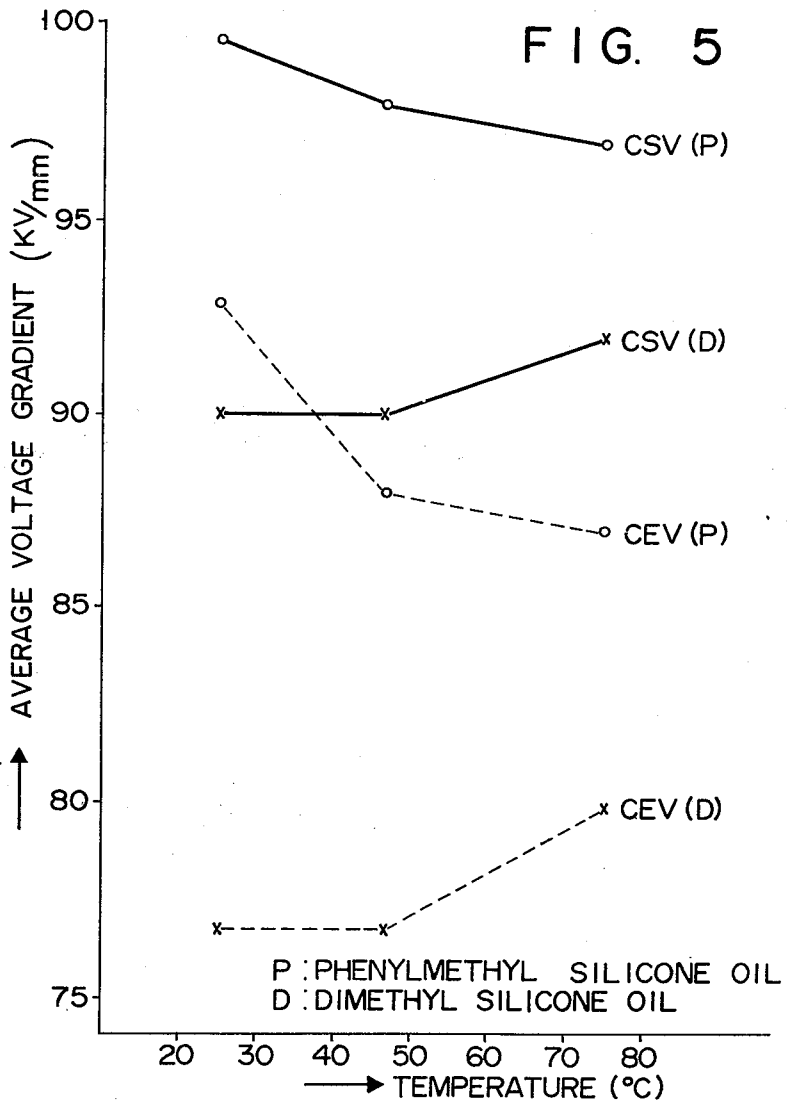
FIG. 5 is a graph showing a relation between the corona voltage and temperature characteristic of the capacitor using a silicone oil as an impregnating oil.

5. As the content of phenyl radical is increased, a kinematic viscosity is increased as shown in Table 1 and a pour point tends to become higher. Heat resistance is increased. Since, however, liberation of carbons also occurs due to arc discharge, it is preferred that the content of phenyl radical be not very high. With the foregoing results in view, capacitors impregnated with phenylmethylsilicone oil and dimethylsilicone oil, respectively, were manufactured based on the all-film method and the corona voltage-temperature characteristic of the respective capacitors was examined. The results are shown in FIG. 5. As will be appreciated from FIG. 5, a ratio of the corona eliminating voltage (CEV) to the corona starting voltage (CSV) is increased to about 0.9 by using the linear phenylmethylsilicone oil as an impregnating oil.

From the foregoing results, the following conclusions may be drawn.

The linear phenylmethylsilicone oil has an excellent hydrogen gas absorption property as compared with the dimethylsilicone oil. The hydrogen gas absorption of the linear phenylmethylsilicone oil is prominent i.e. more than 0.5 mol % based on the whole phenyl radical. Particularly, the peak of the hydrogen gas absorption is in a range of 1–3 mol %. It is not required that the content of phenyl radicals be very great i.e. more that 9.0 mol %. In the capacitor using the linear phenylmethylsilicone oil, an anti-corona property can be markedly improved and the voltage gradient can be enhanced. As the content of phenyl radicals is increased, a kinematic viscosity is rapidly increased and a pour point is raised. As a result, a bad influence is exerted on the stationary electric device. In other words, when the stationary electric device such as capacitors, transformers etc. are held at low temperatures in the winter season, the kinematic viscosity is raised with the result that the cooling effect of the stationary electric device is affected. Furthermore, the impregnation of the impregnating oil into the dielectric is lowered. Consequently, with respect to the low temperature characteristic of the impregnating oil it is required that the linear phenylmethylsilicone oil used in this invention have a property of the same extent as that of the dimethylsilicone oil (A oil). This requirement can be satisfied by making the kinematic viscosity of the linear phenylmethylsilicone oil less than 120 centistokes at 25°C and the content of phenyl radicals less than 9.0 mol %. If, on the other hand, a low viscosity linear phenylmethylsilicone oil is used, a low molecular siloxane is mixed into the oil. For this reason, weight loss on heating is increased and a flashing point is lowered. To impart a fire retardancy to the oil it is required that the flashing point as measured by ASTM E134 Pensky-Maltens method and ASTM D-92 Cleveland method be more than 240°C i.e. the kinematic viscosity at 25°C be more than 30 centistokes. Though low molecular-low viscosity branched phenylmethylsilicone oils have been developed as a PCB substitute oil, they are low in flashing point and involve a greater weight loss on heating. Therefore, they are unsuitable as the oil recommended instead of PCB.

Let us now explain a transformer using the linear phenylmethylsilicone oil as an insulating oil.

Figure 6:
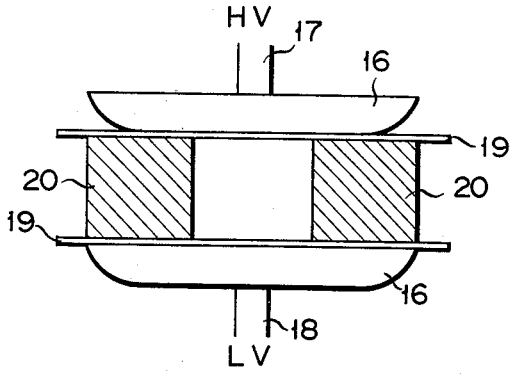
FIG. 6 is a plan view of a test model for evaluating an insulating oil of a transformer according to one embodiment of this invention.
Figure 7:
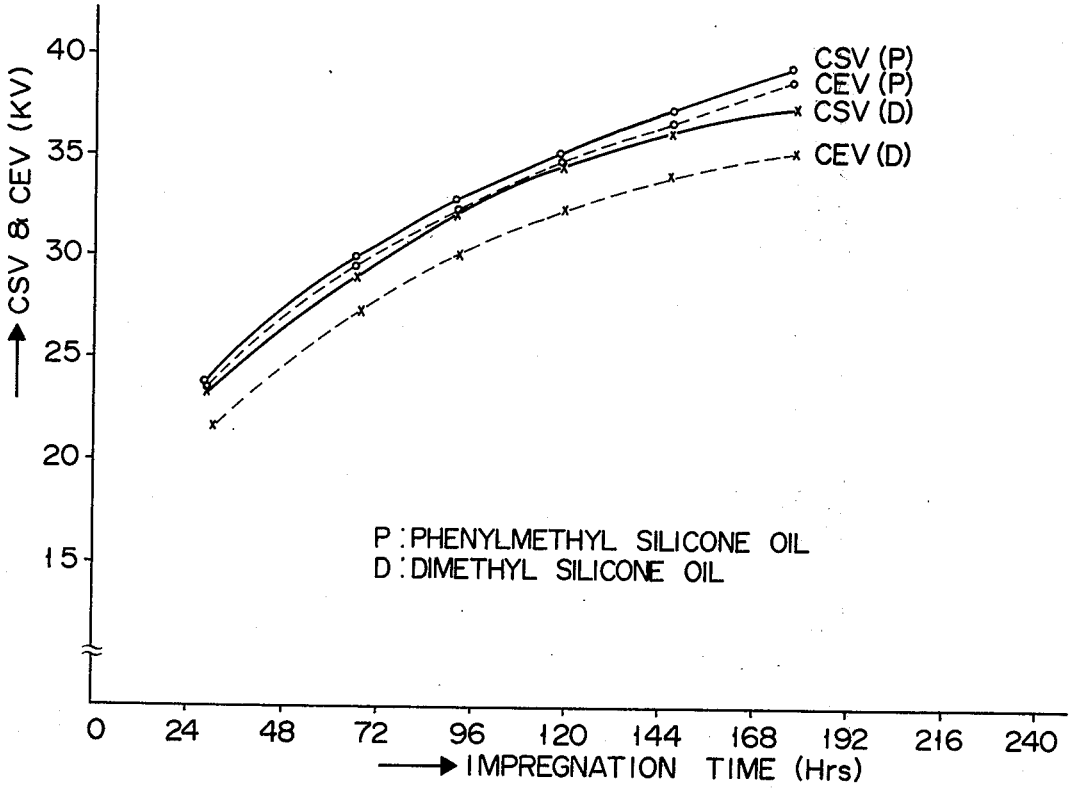
FIG. 7 is a graph showing a relation between the corona voltage and impregnation time of the test model of FIG. 6 in which a silicone oil is used as an insulating oil.

To evaluate the silicone oil as an insulating oil for class H oil-immersed transformer, such a test model as shown in FIG. 6 was manufactured. In the Figure, 16 shows electrodes; 17 is a high voltage side; 18 is a low voltage side; 19 is a Nomex No. 410 (commercially available under the trade name of Aramid paper) (0.8 m/m for collar use); and 20 is a Nomex No. 410 Aramid paper (0.8 m/m × 10). The model was vacuumly dried. Then, a dimethylsilicone oil and phenylmethylsilicone oil were poured at vacuum into the model. After the model was deaerated, the corona starting voltage (CSV) and corona eliminating voltage (CEV) were measured following the time for the impregnation. The results are shown in FIG. 7. As will be evident from FIG. 7, a ratio of CEV to CSV of the phenylmethylsilicone oil is improved as compared with the dimethylsilicone oil and the CSV value is improved with the impregnating time. From these it will be appreciated that the phenylmethylsilicone oil has an excellent gas absorption property.

In the class H oil-immersed transformer, Aramid paper commercially available under the trade name Nomex is frequently used as an insulating paper. By combining this transformer with linear phenylmethylsilicone oil a voltage gradient can be improved to a greater extent. Where the dimethylsilicone oil is used in the above-mentioned transformer, a voltage gradient is about 5 KV/mm. This value is vary low compared with a voltage gradient value, i.e., about 10 KV/mm, as obtained where a normal oil-immersed paper is used. As a result, lots of insulating paper are of necessity required with the attendant poor impregnation. According to this invention the disadvantage is eliminated by using the phenylmethylsilicone oil. This leads to the miniaturization of the device as well as the improvement of reliability.

As the insulating paper and the plastics film use may be made of the above-mentioned materials as well as the other synthetic fiber paper and heat-resistant films.

As mentioned above, according to this invention the anti-corona property as well as the voltage gradient can be improved. Therefore it is possible to provide a high-reliable stationary electric device capable of being miniaturized.

What we claim is:

1. In a stationary electric device containing as an impregnating oil a straight-chain phenylmethylsilicone oil whose organic radical consists of methyl radicals and phenyl radicals, the improvement wherein said phenylmethylsilicone oil has a kinematic viscosity at 25°C in the range of 30–120 centistokes and the ratio of the phenyl radical to the whole organic radical is 0.5–9.0 mol %.

2. A stationary electric device according to claim 1 in which said phenylmethylsilicone oil is a diphenylmethylsilicone oil.

3. A stationary electric device according to claim 1 in which said phenylmethylsilicone oil is a monophenylmethylsilicone oil.

4. A stationary electric device according to claim 1 in which said ratio of the phenyl radical to the whole organic radical is 1.0–3.0 mol %.

5. In a capacitor containing as an impregnating oil a phenylmethylsilicone oil whose organic radical consists of methyl radicals and phenyl radicals, the improvement wherein said phenylmethylsilicone oil has a kinematic viscosity at 25°C in the range of 30–120 centistokes and the ratio of the phenyl radical to the whole organic radical is 0.5–9.0 mol %.

6. A capacitor according to claim 5 in which the ratio of the phenyl radical to the whole organic radical is 1.0–3.0 mol %.

7. In a transformer containing as an impregnating oil a phenylmethylsilicone oil whose organic radical consists of methyl radicals and phenyl radicals, the improvement wherein said phenylmethylsilicone oil has a kinematic viscosity at 25°C in the range of 30–120 centistokes and the ratio of the phenyl radical to the whole organic radical is 0.5–9.0 mol %.

8. A transformer according to claim 7 in which said ratio of phenyl radical to the whole organic radical is 1.0–3.0 mol %.

* * * * *